United States Patent [19]

Kutik et al.

[11] 4,225,060

[45] Sep. 30, 1980

[54] CONTINUOUS PUMPING SYSTEM

[75] Inventors: Louis F. Kutik, Ft. Lauderdale; Howard E. Cecil, Miami Lakes, both of Fla.

[73] Assignee: Security Plastics, Inc., Miami Lakes, Fla.

[21] Appl. No.: 974,328

[22] Filed: Dec. 29, 1978

[51] Int. Cl.[3] ..... B05B 11/00

[52] U.S. Cl. ..... 222/189; 222/340; 222/380

[58] Field of Search ..... 222/259, 321, 340, 380, 222/382, 385, 189, 464, 402.15; 239/529, 331, 333, 575, 590.3; 417/541

[56] References Cited

U.S. PATENT DOCUMENTS

| | | | |
|---|---|---|---|
| 3,061,202 | 10/1962 | Tyler | 222/341 X |
| 3,379,381 | 4/1968 | Decaux | 239/333 |
| 3,923,250 | 12/1975 | Boris | 222/385 X |
| 4,035,303 | 7/1977 | Ufferfilge | 222/189 X |
| 4,109,832 | 8/1978 | Kutik et al. | 222/321 X |

FOREIGN PATENT DOCUMENTS

| | | | |
|---|---|---|---|
| 1465589 | 12/1966 | France | 222/189 |
| 7710014 | 4/1978 | Netherlands | 239/331 |

*Primary Examiner*—Robert J. Spar
*Assistant Examiner*—Frederick R. Handren
*Attorney, Agent, or Firm*—Oltman and Flynn

[57] ABSTRACT

A pumping system is disclosed in which a storage compartment formed by a spring loaded piston and cylinder assembly is provided with a spring which stays at a relatively constant length when pumping product to keep a relatively constant pressure on the product to maintain a steady stream or spray of product emerging from the pumping system. A vent structure is provided by a double seal arrangement which allows the mounting ring and a main cylinder of the pumping system to be made in one piece.

16 Claims, 12 Drawing Figures

CONTINUOUS PUMPING SYSTEM

RELATED PATENTS

This application is related to U.S. Pat. No. 4,079,865 of Louis F. Kutik and also to U.S. patent application Ser. No. 905,380 filed on May 12, 1978 by Louis F. Kutik and Howard E. Cecil.

BACKGROUND OF THE INVENTION

The aforementioned Patent and Patent Application disclose and claim a pumping system in which a quantity of pressurized product is stored in a storage compartment during a pressurizing stroke and discharged through an outlet orifice during a succeeding intake stroke to maintain a stream or spray issuing from the system. The present invention is directed to a special arrangement for a spring of the storage piston and cylinder device which is especially advantageous for keeping the stream or spray relatively steady. The pumping system of the type disclosed in the Patent and Patent Application identified above may also include a novel vent structure and a novel strainer arrangement in accordance with this invention.

SUMMARY OF THE INVENTION

The invention provides a spring actuation arrangement for a storage piston and cylinder device in a pumping system whereby the spring of the device remains at a relatively constant length when pumping product for keeping the pressure on the product relatively constant and thus keeping the stream or spray issuing from the pumping system relatively constant. The spring tends to extend when pumping air during priming of the pump so that low pressure air can escape from the pumping system relatively easily, thus aiding in priming the pumping system. The invention also includes a novel vent structure provided by a double seal arrangement which makes it possible to mold a mounting ring and cylinder of the main piston and cylinder device of the pumping system in one piece of plastic. The vent arrangement prevents product from emerging from the container when the container is shaken or squeezed. A novel double straining arrangement is also provided wherein product is strained where it leaves a dip tube emerging from the container, and is strained again at an outlet opening arrangement in a storage cylinder of the pumping system.

Accordingly, it is an object of the present invention to provide a pumping system in which a part of the pressurized product is stored at a relatively constant pressure for keeping a stream or spray emerging from the pumping system relatively steady.

Another object of the invention is to provide a one piece mounting ring and cylinder unit for a pumping system.

Another object of the invention is to provide a novel strainer arrangement for a pumping system.

Another object of the invention is to provide an improved vent structure for a pumping system which is compatible with a one piece mounting ring and cylinder arrangement.

Another object of the invention is to provide strainers for a pumping system which are self-cleaning.

Other objects of this invention will appear from the following description and appended claims, reference being had to the accompanying drawings forming a part of this specification wherein like reference characters designate corresponding parts in the several views.

Figures 1, 2, 3:
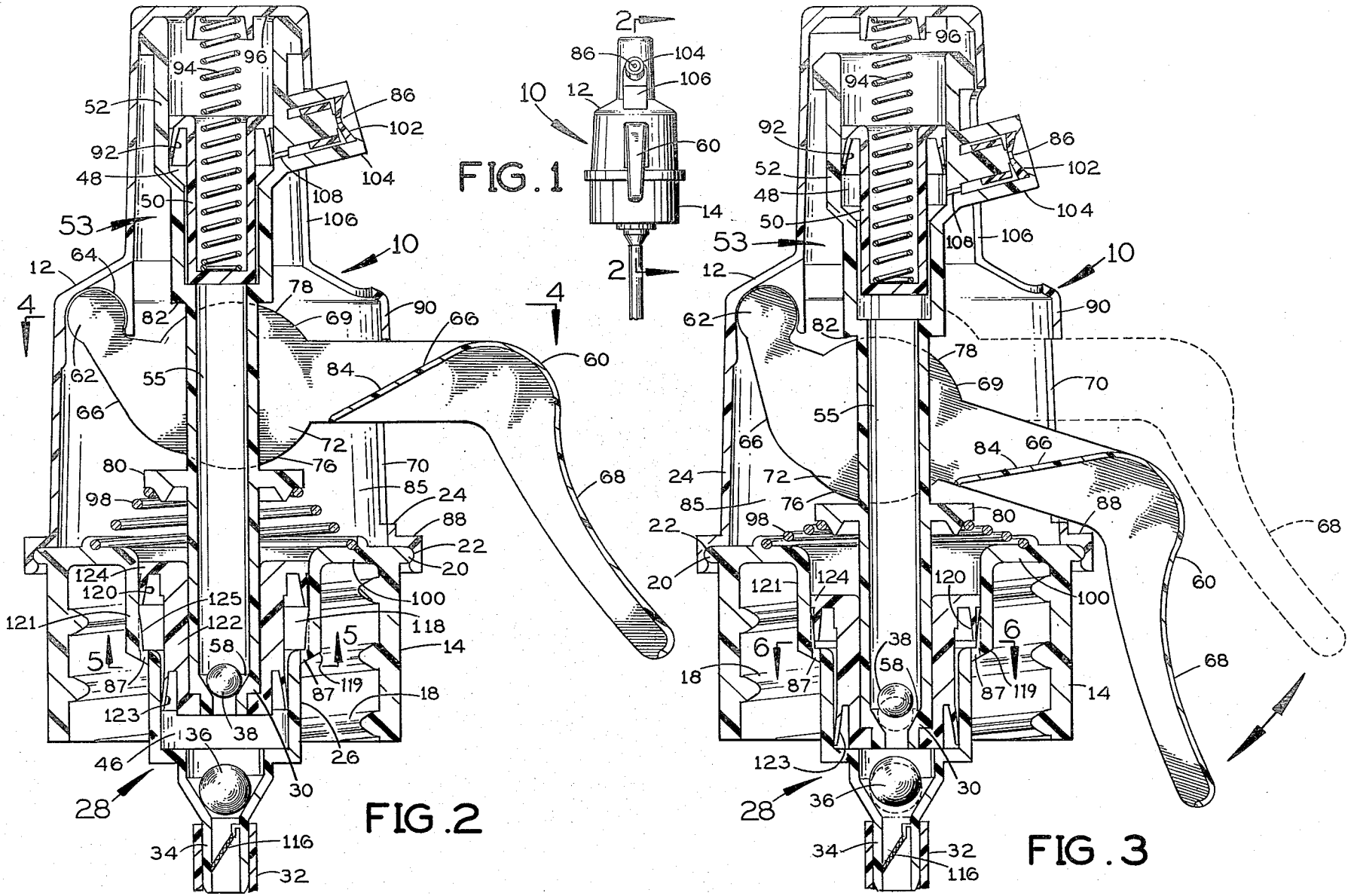
FIG. 1 is an elevational view of a pumping system in accordance with the invention.
FIG. 2 is a sectional view taken along line 2—2 of FIG. 1.
FIG. 3 is a sectional view similar to FIG. 2, but showing an actuating lever of the pumping system in a depressed condition.

Before explaining the disclosed embodiments of the present invention in detail, it is to be understood that the invention is not limited in its application to the details of the particular arrangements shown since the invention is capable of other embodiments. Also, the terminology used herein is for the purpose of description and not of limitation.

DETAILED DESCRIPTION

The Pumping System

The pumping system 10 includes a housing 12 having a mounting ring 14 as part thereof to be affixed to a container. The mounting ring 14 has internal threads 18 for engaging threads on the neck of the container. The mounting ring 14 has a lip 20 which slidably engages in a grove 22 of the shell 24 of the of the housing 12 so that the shell 24 can be rotated relative to the mounting ring 14. The housing 12 also includes a cylinder 26 of a piston and cylinder device generally designated 28 and also including a piston 30. The piston and cylinder device 28 serves to withdraw a quantity of product from the container through a dip tube 32 on an intake stroke and to pressurize that quantity of product during a pressurizing stroke of the piston 30. The cylinder 26 serves as part of the piston ane cylinder device 28 and also as part of the housing 12. The cylinder 26 has a reduced tip 34 for attachment to the dip tube 32.

The piston and cylinder device 28 also includes two check valves 36 and 38. The check valve 38 is located at the outlet of a pressurizing compartment 46 and also serves as the inlet for a storage compartment 48 which also includes an accumulator piston 50 and a cylinder 52 forming a second piston and cylinder device 53. The storage compartment 48 communicates with the check valve 38 through a space 55 inside piston 30, and the piston 30 is constructed as a cylinder which may be an integral part of the cylinder 52.

The first cylinder 26 is integral with the mounting ring 14 in one piece of plastic. The check valve 38 is normally seated on a valve seat 58, but it can rise from that seat during the pressurizing stroke of the piston 30 to admit product through the space 55 into the storage compartment 48. The space 55 may be considered as an extension of the storage compartment 48. The product in the container 16 is normally a liquid and it flows past the check valve 36 into the pressurizing compartment on an intake stroke of the piston 30.

The piston 30 is actuated by a lever 60. A pivot means including tips 62 and snap acting recesses 64 in the housing 12 pivotally connect the left end of the lever 60 to the shell 24 (part of the housing 12) at the left side of the piston 30. This tips and recesses may be reversed.

The lever includes a first arm 66 which has an intermediate portion 69 engaging the piston 30 and the cylinder 52 for operating the piston by reciprocating movement of the lever. The lever 60 includes a second arm 68 depending from the first arm on the right side of the piston 30 to provide a finger actuated trigger outside the housing 12. The lever 60 extends through a slot 70 formed in the shell 24, and the slot 70 is long enough in the vertical direction to permit the lever 60 to reciprocate. The intermediate portion 69 applies to the piston 30 a force which is greater than the force applied to the trigger arm 68.

The intermediate portion 69 of the lever includes spaced portions 72 straddling the piston 30. The portions 72 have rounded edges at 76 and 78 which respectively engage projection 80 and cylinder shoulder 82 for raising and lowering the piston as the lever 60 reciprocates. The shell 24 can be turned by pushing the lever sideways.

The arm 60 slants upwardly and outwardly and the trigger arm 68 of the lever 60 slants downwardly and outwardly from the outward end of the arm 66, such that the trigger arm 68 may be actuated by downwardly and inwardly directed force supplied thereto by the finger of a person who is operating the pumping system when the pumping system is in an upright position as shown in FIGS. 1–3. In a particular embodiment, 5 pounds of force applied to the trigger will build up to about 50 psi in the pump. Pressures of over 120 psi have been achieved in some pumps.

The arm 66 includes a downwardly and inwardly sloping ramp 84 located under a restricted outlet orifice 86 of the pumping system. The arm 66 extends outwardly from the piston 30 well beyond the restricted outlet orifice 86 such that any drips coming from the orifice 86 will be received by the ramp 84 and returned downward through space 85 into the cylinder 26. The trigger arm 68 is located well outward beyond the orifice 86 so that drips from the orifice do not drip on the fingers of the person operating the pumping system. From the cylinder 26, the drips are returned to the container 16 through a vent opening 87 when the opening 87 is unblocked as will be explained.

The lever 60 is shown in a depressed condition in FIG. 3 as it would appear just after a pressurizing stroke of the piston 30. It may be seen that a shelf 88 on the shell 24 at the bottom of slot 70 forms a stop for limiting the downward movement of the lever 60. The lever 60 is shown in a raised rest position as it would appear just at the end of an intake stroke of the piston 30 in FIG. 2. A bridge 90 forms a stop for limiting the upward movement of the lever 60, and the bridge 90 is part of the shell 24 located at the upper end of the slot 70.

The accumulator piston 50 has a resilient skirt 92 which sealingly engages the wall of the storage cylinder 52 and acts to control the flow of product to the outlet orifice 86. The accumulator piston 50 is biased downwardly by a spring 94 which has a lower end engaging the bottom of the piston 50 and an upper end engaging the top 96 of the housing 12 at the top of the storage cylinder 52. The storage cylinder is open at the top to enable the spring 94 to engage the housing at the top thereof. The piston 30 is urged upwardly by a spring 98 which has a lower end engaging a shelf 100 and an upper end engaging the projection 80 on the piston 30.

Figure 7:
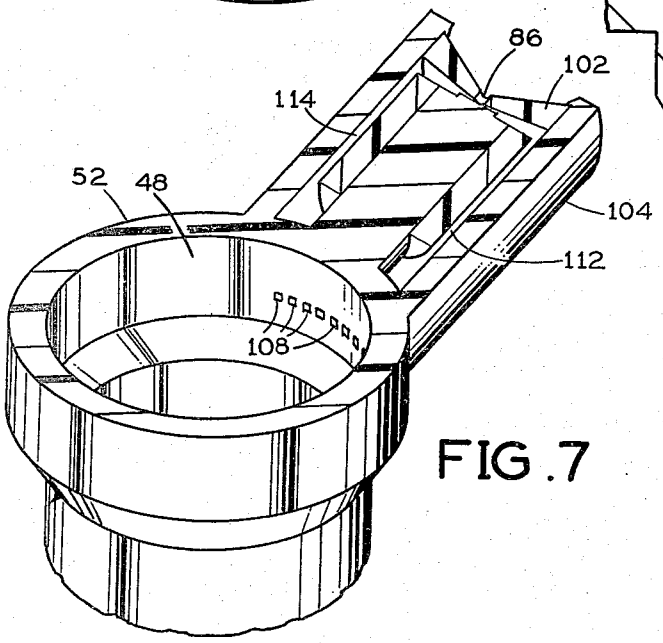
FIG. 7 is a fragmentary perspective view of an outlet section of the pumping system.

As shown in FIGS. 2 and 3, the restricted outlet orifice 86 is formed in a spray button 102 which is inserted in a circular projection 104 that rides in a slot 106 formed in the upper part of the shell 24. The projection 104 projects outwardly from the storage cylinder 52. An outlet opening is formed by a plurality of horizontally spaced openings 108 (FIG. 7) which communicate from the storage compartment 48 through channels 112 and 114 with the restricted outlet orifice 86. The restricted outlet orifice is located at the outlet of the storage compartment and completely controls the rate of product discharge therethrough so as to allow only a portion of the pressurized product to be dispensed from the pump during the pressurizing stroke, when pumping relatively rapidly, the remainder of the product being stored in the storage compartment to be dispensed during a subsequent intake stroke of the piston 30 by contraction of the storage compartment to maintain the stream or spray from the orifice when the pressurizing pump is receiving product on its intake stroke.

The action of the accumulator piston 50 is shown in FIGS. 2 and 3. After a pressurizing stroke of the lever 60, the accumulator piston 50 is in a raised position as shown in FIG. 3. Until the accumulator piston engages the top 96, the spring 94 determines the pressure under which the product is stored in the storage compartment 48. During the intake stroke of the lever 60, the accumulator piston 50 moves downwardly to maintain the stream or spray issuing from the orifice 86 so that the stream or spray is relatively continuous when pumping rapidly. In the rest condition of the accumulator piston 50 shown in FIG. 2, the skirt 92 of the accumulator piston closes the outlet openings 108 and 110 to completely shut off flow of product to the restricted outlet orifice 86. The skirt 92 wipes the small outlet openings 108 to keep them clean, and the outlet openings are each smaller in area than the restricted orifice 86 so that they act as a filter.

Figure 9:
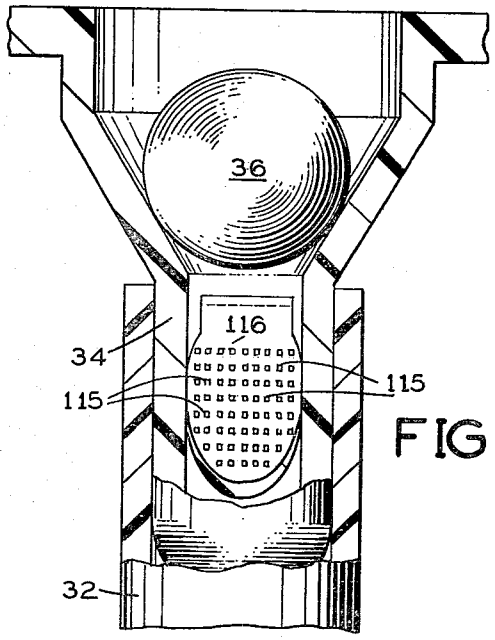
FIG. 9 is an enlarged fragmentary sectional view showing the strainer from a different angle.
Figure 8:
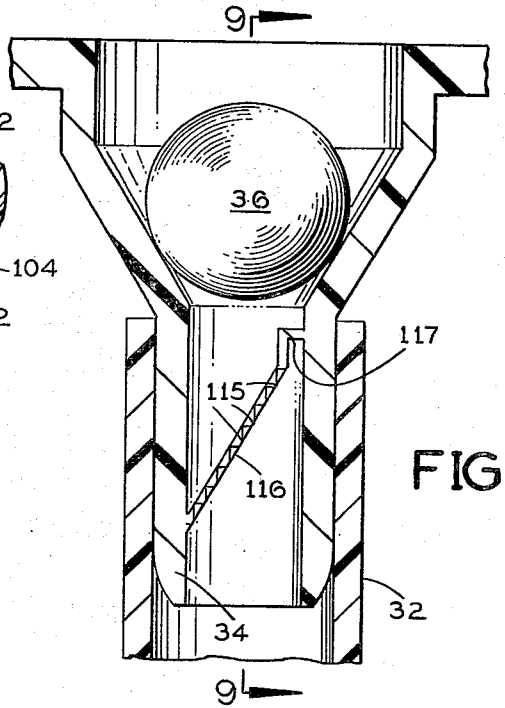
FIG. 8 is an enlarged fragmentary sectional view of a lower strainer of the pumping system.

A strainer 116 is shown particularly in FIGS. 8 and 9. The strainer 116 is a slanting member molded across the inside of the tip 34. It has small openings 115 each smaller than the area of the restricted outlet orifice 86 so that they will catch particles or other foreign matter in the product flowing through the dip tube and prevent that foreign matter from clogging the outlet orifice 86. If any one of the openings 115 becomes clogged, there are other openings which will act to continue the straining action. The strainer 116 cooperates with the filtering outlet openings 108 to keep the outlet orifice 86 from becoming clogged. The strainer 116 has an upper pocket 117 to catch excess foreign matter. The openings in strainer 116 are tapered with the small side down, so the lower side of the strainer is smooth to allow particles to slide up to the pocket.

The pumping system also includes a vent means designated generally 118. The vent means includes the vent opening 87 formed in a shoulder 119 and also includes a seal 120 in the form of a circular skirt resiliently engaging the inside of a third cylinder 121 which is joined to the first cylinder 26 by the shoulder 119. The third cylinder 121 is larger in diameter than the first cylinder 26. The sealing skirt 120 depends from a ring 122 which is affixed to the bottom of the piston 30 such that the ring and the sealing skirt 120 may be made of a softer marterial than the piston 30. The vent means also includes a guide 124 in the form of an interrupted ring slidably engageable with the inside surface of the cylinder 121 for guiding the movement of the piston 30 without distorting the sealing skirt 120. This guide 124 may be relatively rigid so as to properly center the piston 30 while allowing the seal 120 to function properly.

The ring 122 has another sealing skirt 123 resiliently engaging the inside of the first cylinder 26. The sealing skirt 123 acts as the main piston seal. Skirt 123 is below shoulder 119 and skirt 120 is above shoulder 119.

Figure 6:
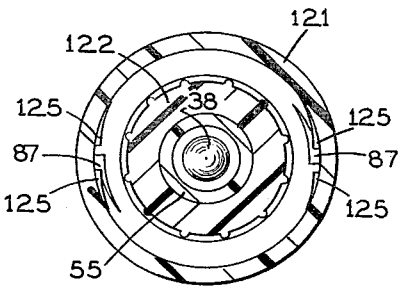
FIG. 6 is a sectional view taken along line 6—6 of FIG. 3.
Figure 5:
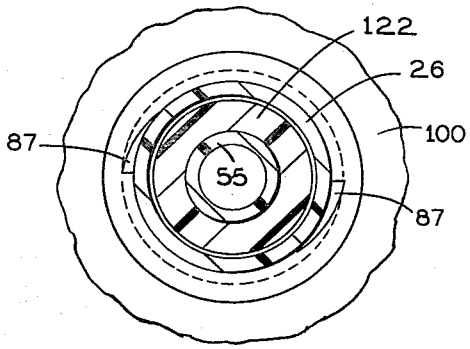
FIG. 5 is a sectional view taken along line 5—5 of FIG. 2.
Figure 4:
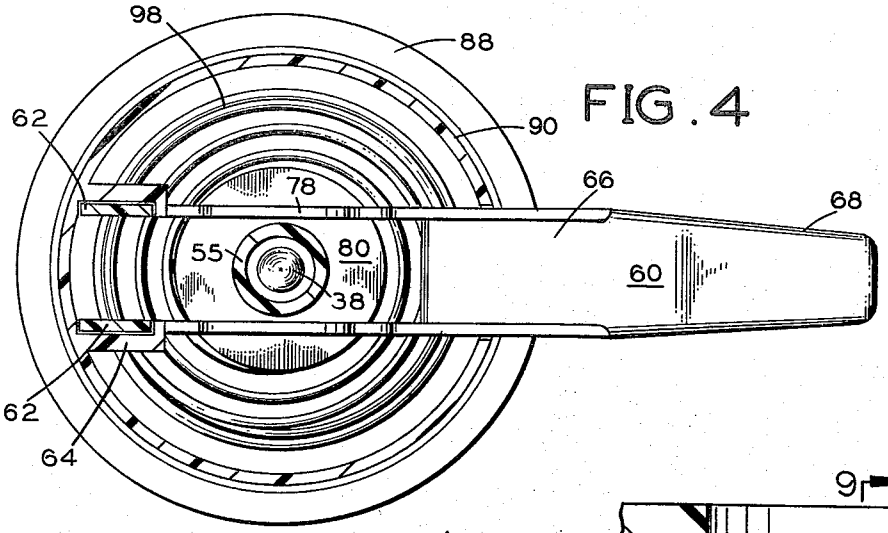
FIG. 4 is a sectional view taken along line 4—4 of FIG. 2.

When the lever 60 is in its raised position, the sealing skirt 120 acts to block the vent opening 87. When the lever 60 is depressed as shown in FIG. 6, ribs 125 interrupt the seal of skirt 120 and the interior of the container 16 is vented to the atmosphere through the vent opening 87, thus allowing the pressure inside the container to equalize with atmospheric pressure. At this time any drips which have flowed from the ramp 84 into the cylinder 26 can return to the container 16 through the vent opening 87. The seal of skirt 120 could be interrupted by simply making cylinder 121 taper downwardly and outwardly.

The pressure between the seals 120 and 123 can never exceed the head in the container, and seal 120 prevents product from escaping when the container is shaken or squeezed. Both seals extend in the same direction.

Where the bottom of the accumulator piston 50 engages the offset 82 slots (not shown) are formed in the bottom of the accumulator piston to allow product to flow past the piston.

The cylinder 26 has a very slight upward and outward taper (say ½% of the diameter of cylinder 26) so that pressure on the skirt 123 increases slightly as the skirt descends, and pressure on the skirt 123 is at a minimum in the rest condition of the system. Thus, the skirt 120 does not take a set.

The vent opening 87 may be molded through the shoulder 119 such that it extends helically and has the same or lesser pitch as the threads 18 so that the mold can be unscrewed from the mounting ring. Alternatively, the vent openings 87 may be molded through the shoulder 119 by a pin on the upper mold.

The spring 94 has an important pressure equalizing action. When the lever 60 is up, the spring 94 has a rest position as shown in FIG. 2. When priming the pump, the lever 60 goes down, and cylinder 52 goes down. The spring 94 will extend since the air being pumped is at low pressure. This reduces the pressure on accumulator piston 50 so that it rises to allow the low pressure air to escape through the outlet orifice 86, thus helping to prime the pumping system. Then when product is being pumped, the lever and piston 30 go down to pressurize product, and the high pressure of the product raises the accumulator piston as shown in FIG 3. Product can escape through the restricted orifice. By making the area of the accumulator piston 50 about half the area of the skirt 123, the accumulator piston will rise about the same amount as the piston 30 descends on a pressurizing stroke. Thus, the spring 94 stays at about the same length while pumping product, and the pressure on the stored product remains almost constant to keep the spray steady.

Figures 10, 11, 12:
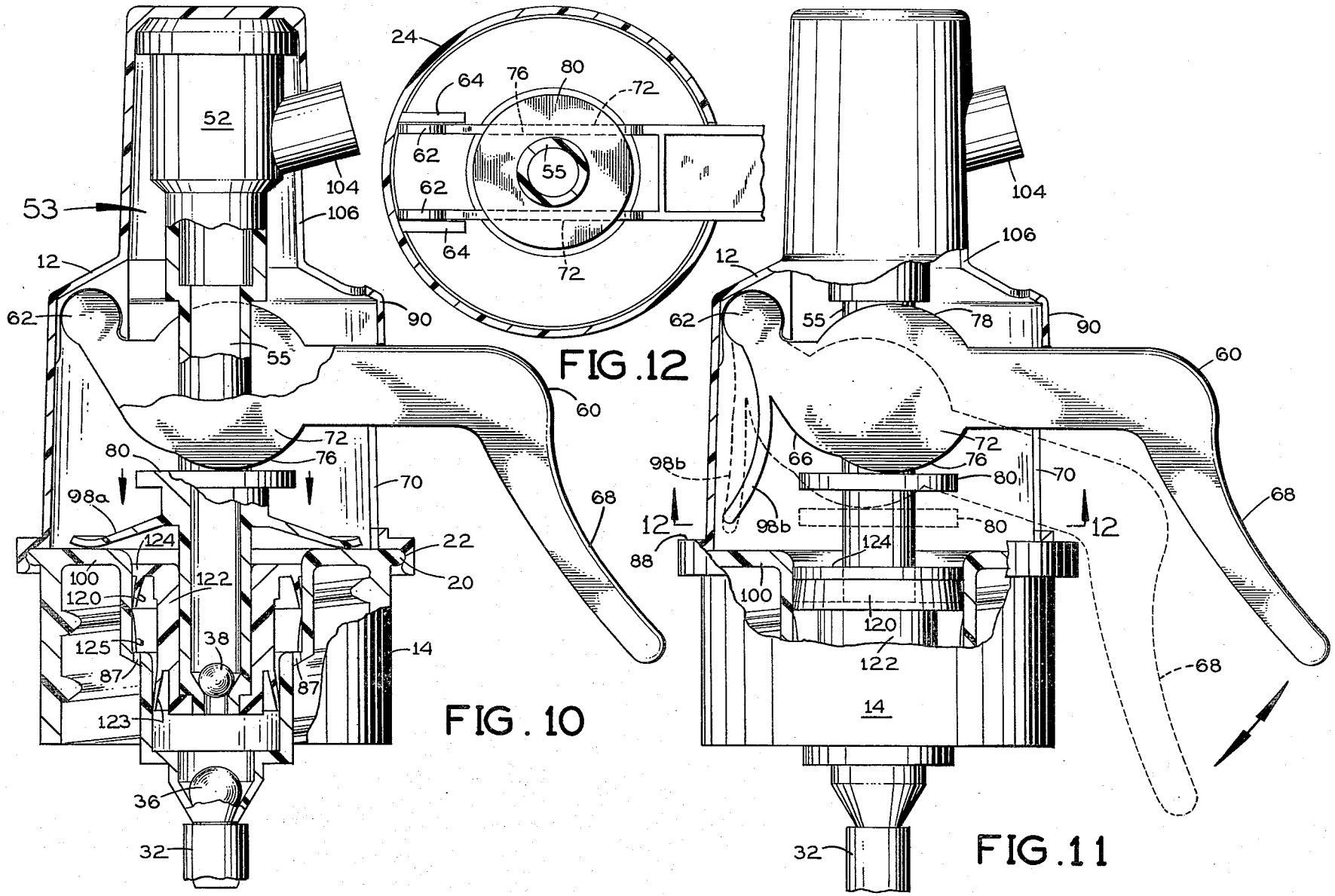
FIG. 10 is a sectional view similar to FIG. 2, but showing a modified spring arrangement for the pumping system.
FIG. 11 is a view similar to FIG. 10, but showing another modified spring arrangement.
FIG. 12 is a sectional view taken along line 12—12 of FIG. 11.

FIGS. 10–12 show modified springs for the main piston and cylinder device. In FIG. 10, the spring 98*a* is molded on the piston 30 and engages the shelf 100. In FIG. 11, the spring 986 is molded on the arm 66 and engages the housing.

It may be advantageous for some applications to have the trigger opposite the spray outlet such as for spraying deodorant.

We claim:

1. In a pumping system for use with a container for product and a dip tube to dispense product from the container through the dip tube, said pumping system including:

a housing with a mounting means to be affixed to the container;

a manually actuated pressurizing pump including first and second check valves and a first spring-loaded piston and cylinder assembly for withdrawing a quantity of product from the container through said dip tube and first check valve during an intake stroke and for pressurizing said quantity of product during a pressurizing stroke;

storage compartment means including a second spring-loaded piston and cylinder assembly expandable for storing, under a pressure determined by said second spring-loaded assembly, a quantity of pressurized product received through said second check valve from said pressurizing pump; and means forming a restricted outlet orifice;

said storage compartment means being functionally located with said restricted outlet orifice at its outlet and said second check valve at its inlet from said pressurizing pump;

said restricted orifice controlling the rate of product discharge therethrough so as to allow only a portion of the pressurized product to be dispensed from said pump during the pressurizing stroke, when pumping relatively rapidly, the remainder of said product being stored in said storage compartment means to be dispensed during the subsequent intake stroke of said first spring-loaded piston by contraction of said storage compartment means to maintain the stream or spray from the orifice when the pressurizing pump is receiving product on its intake stroke;

said storage compartment means including an outlet opening in communication with said outlet orifice, said outlet opening being disposed relative to said second spring-loaded piston so that it is opened and closed by movement of the second spring-loaded piston thereby completely controlling the flow to the restricted orifice;

said second piston moving upward to open said outlet opening and downward to close said outlet opening in the upright position of said pumping system;

the improvement wherein:

said first and second pistons are respectively biased by first and second spring means for operating said pistons and said second piston is coupled for movement with said first piston; and said second spring means has an upper end engaging a stationary portion of said housing over said storage compartment means and a lower end engaging said second piston such that said second spring means exerts a relatively steady pressure on said second piston when product is being dispensed from said pumping system;

said second spring means extending during the pressurizing stroke of said first piston and cylinder assembly due to downward movement of said first piston when said pumping system is pumping air during priming of said pump to reduce the pressure of said second spring means on said second piston which moves upward to open said outlet opening and allows air to escape from said outlet orifice at low pressure for aiding in priming the pumping system.

2. The pumping system as claimed in claim 1 in which:

said first cylinder and said mounting means are integral with each other in one piece of plastic; and a third cylinder integrally joined to said first cylinder by a shoulder and having a different diameter than said first cylinder;

said shoulder having a vent opening therethrough.

3. The pumping system as claimed in claim 2 in which:

said first piston has a first resilient sealing skirt projecting downward and sealingly engaging said first cylinder below said shoulder; and a second resilient sealing skirt projecting downward and sealingly engaging said third cylinder above said shoulder.

4. The pumping system as claimed in claim 3 in which:

said first cylinder has a lower tubular portion having a slanting screen therein.

5. The pumping system as claimed in claim 4 in which:

said outlet opening comprises a plurality of small openings in said second cylinder each smaller than said restricted orifice and wiped by said second piston for cleaning purposes.

6. The pumping system as claimed in claim 3 in which:

said third cylinder has means for interrupting the seal of said second skirt to admit air to the container through said vent opening.

7. The pumping system as claimed in claim 1 in which: said first spring means comprises a leaf spring.

8. In a pumping system for use with a container for product and a dip tube to dispense product from the container through the dip tube, said pumping system including:

a housing with a mounting means to be affixed to the container;

a manually actuated pressurizing pump including first and second check valves and a first spring-loaded piston and cylinder assembly for withdrawing a quantity of product from the container through said dip tube and first check valve during an intake stroke and for pressurizing said quantity of product during a pressurizing stroke, said first cylinder also acting as part of said housing for attachment to the dip tube;

storage compartment means including a second spring-loaded piston and cylinder assembly expandable for storing, under a pressure determined by said second spring-loaded assembly, a quantity of pressurized product received through said second check valve from said pressurizing pump; and means forming a restricted outlet orifice;

said storage compartment means being functionally located with said restricted outlet orifice at its outlet and said second check valve at its inlet from said pressurizing pump;

said restricted orifice controlling the rate of product discharge therethrough so as to allow only a portion of the pressurized product to be dispensed from said pump during the pressurizing stroke, when pumping relatively rapidly, the remainder of said product being stored in said storage compartment means to be dispensed during the subsequent intake stroke of said first spring-loaded piston by contraction of said storage compartment means to maintain the stream or spray from the orifice when the pressurizing pump is receiving product on its intake stroke;

said storage compartment means including an outlet opening in communication with said outlet orifice, said outlet opening being disposed relative to said second spring-loaded piston so that it is opened and closed by movement of the second spring-loaded piston thereby completely controlling the flow to the restricted orifice;

the improvement wherein:

said first cylinder and said mounting means are integral with each other in one piece of plastic; and a third cylinder integrally joined to said first cylinder by a shoulder and having a different diameter than said first cylinder;

said shoulder having a vent opening therethrough;

said first and second pistons being respectively biased by first and second spring means for operating said pistons and said second piston being coupled for movement with said first piston; and said second spring means having an upper end engaging a stationary portion of said housing over said storage compartment means and a lower end engaging said second piston such that said second spring means exerts a relatively steady pressure on said second piston when product is being dispensed from said pumping system;

said second spring means extending during the pressurizing stroke of said first piston and cylinder assembly due to downward movement of said first piston when said pumping system is pumping air during priming of said pump to reduce the pressure of said second spring means on said second piston which moves upward to open said outlet opening and allows air to escape from said outlet orifice at low pressure for aiding in priming the pumping system.

9. The pumping system as claimed in claim 8 in which:

said first piston has a first resilient sealing skirt projecting downward and sealingly engaging said first cylinder below said shoulder; and a second resilient sealing skirt projecting downward and sealingly engaging said third cylinder above said shoulder.

10. The pumping system as claimed in claim 8 in which:

said first cylinder has a lower tubular portion having a slanting screen therein.

11. The pumping system as claimed in claim 8 in which:

said outlet opening comprises a plurality of small openings in said second cylinder each smaller than said restricted orifice and wiped by said second piston for cleaning purposes.

12. The pumping system as claimed in claim 8 in which:

said third cylinder has means for interrupting the seal of said second skirt to admit air to the container through said vent opening.

13. In a pumping system for use with a container for product and a dip tube to dispense product from the container through the dip tube, said pumping system including:

a housing with a mounting means to be affixed to the container;

a manually actuated pressurizing pump including first and second check valves and a first spring-loaded piston and cylinder assembly for withdrawing a quantity of product from the container through said dip tube and first check valve during an intake stroke and for pressurzing said quantity of product during a pressurizing stroke the improvement wherein:

said cylinder and said mounting means are integral with each other in one piece of plastic; and another cylinder joined integrally to said first cylinder by a shoulder and having a different diameter than said first cylinder;

said shoulder having a vent opening through the same;

said piston having a first resilient sealing skirt projecting downward and sealingly engaging said first cylinder below said shoulder; and a second resilient sealing skirt projecting downward and sealingly engaging said other cylinder above said shoulder.

14. The pumping system as claimed in claim 13 in which said vent opening is in the form of a helical opening.

15. The pumping system as claimed in claim 13 in which:

the first cylinder has a lower tubular portion having a slanting screen therein with an upper pocket portion.

16. The pumping system as claimed im claim 13 in which:

said other cylinder has means for interrupting the seal of said second skirt to admit air to the container through said vent opening.

* * * * *